United States Patent [19]

Peabody et al.

[11] 4,213,306

[45] Jul. 22, 1980

[54] METHOD AND APPARATUS FOR INCREASING AIR CONDITIONER EFFICIENCY

[75] Inventors: William A. Peabody, 7918 E. 18th Pl., Tucson, Ariz. 85710; Ernest M. Schaaf, Tucson, Ariz.

[73] Assignee: William A. Peabody, Tucson, Ariz.

[21] Appl. No.: 913,528

[22] Filed: Jun. 7, 1978

[51] Int. Cl.[2] ..... F25B 47/00; F28D 5/00

[52] U.S. Cl. ..... 62/85; 62/305

[58] Field of Search ..... 62/85, 305; 204/148, 204/197

[56] References Cited

U.S. PATENT DOCUMENTS

| | | | |
|---|---|---|---|
| 2,995,018 | 8/1961 | Dempsey, Jr. | 62/305 |
| 3,383,045 | 5/1968 | Van Dyck | 62/305 |
| 3,613,392 | 10/1971 | Di Tucci | 62/305 |
| 3,835,015 | 9/1974 | Gary | 204/148 |
| 3,919,068 | 11/1975 | Gary | 204/197 |
| 3,928,155 | 12/1975 | Woodhouse | 204/197 |
| 3,938,352 | 2/1976 | Schdmidt | 62/305 |
| 3,979,923 | 9/1976 | Jennings | 62/305 |
| 4,028,906 | 6/1977 | Gingold et al. | 62/305 |
| 4,056,946 | 11/1977 | Bond et al. | 62/305 |
| 4,069,687 | 1/1978 | Larriva | 62/305 |

FOREIGN PATENT DOCUMENTS

| | | | |
|---|---|---|---|
| 526749 | 9/1975 | U.S.S.R. | 62/305 |

*Primary Examiner*—Lloyd L. King

*Attorney, Agent, or Firm*—J. Michael McClanahan

[57] ABSTRACT

A method and apparatus for increasing air conditioner efficiency comprising means and method to cool the high temperature high pressure gas output of the air conditioning unit compressor pump at or before the unit condenser utilizing water which has been pre-treated to retain particulate matter dissolved and suspended therein in order that scale not be formed upon the high pressure tubing and fins of the condenser. As a result of the cooling, the air conditioning unit operates with increased efficiency and reduced compressor head pressures for longer life. Additionally, means and method are provided for controllably regulating the flow of the cooling water and spray to protect the compressor from damage as a result of the increased efficiency.

17 Claims, 8 Drawing Figures

METHOD AND APPARATUS FOR INCREASING AIR CONDITIONER EFFICIENCY

BACKGROUND OF THE INVENTION

With the rising costs of electrical energy, it has been the desire and aspiration of those connected with the air conditioning industry to reduce the cost of cooling by making the air conditioning units more efficient. One means of increasing the efficiency is to provide better cooling means for the hot refrigerant gas in the condenser. Most condensers are air cooled and thus depend on forced ambient air for the necessary cooling air. When the ambient air temperature rises, the efficiency of the air conditioner falls and when the air conditioner is needed most, it is least efficient. One method which has been tried is to spray water onto the condenser coils in order that the water, which usually is below the ambient air temperature, may cool the coils by taking in the heat and with some evaporation, taking the caloric value of the heat of vaporization of water from the heated refrigerant.

This would work perfectly well if the source of the water is 100% distilled water. However, most available waters are waters which have particulates either dissolved or suspended therein which upon evaporation, leave behind scale. This scale has an insulating effect and after a short while the value of water cooling the condenser is lost. In addition, the build up of scale upon the condenser coils and between the condenser fins soon renders the condenser non-functional and the air conditioning unit non-usable.

Additionally, in air conditioning units which have been designed to be air cooled, the increased efficiency of the condenser, by cooling as above mentioned, results in lower refrigerant gas pressures throughout the system and imparts the danger of the refrigerant turning to liquid, either in the evaporator after it has been evaporated or in the lines connecting the evaporator with the compressor. Since the compressor is not designed to receive a liquid, but a gas, the attempted compression of the liquid soon results in a damaged compressor.

To this end, the applicants have devised an inventive means and method for adaptation to air cooled condensers where water cooling may be accomplished without the normally attendant scale deposition and the cooling water is cycled in the form of a water spray, taking into account the internal conditions of the air conditioning unit in order that the compressor will not receive the refrigerant in the harmful liquid state.

SUMMARY OF THE INVENTION

The invention disclosed herein comprises a method and apparatus for cooling normally air cooled air conditioning unit condensers with a water spray together with sensing devices to regulate the operation of the water spray so that too much cooling is not achieved such as to damage the compressor. More specifically, water is treated to keep particles dissolved and suspended therein in a state of constant solution and constant suspension and the water is then sprayed onto the condenser coils in a defined pattern by means of a selected spray nozzle and specially designed spray containing housing which attaches to the air conditioner condenser construction. The flow of the water to the air conditioning unit condenser is controllably regulated by sensing the air conditioning unit compressor refrigerant head temperature after the condenser and by sensing the air conditioner unit compressor suction pressure in such a manner that the flow of water to the condenser is inhibited should the head pressure fall below a specified pressure (temperature and pressure are directly related) or should the suction pressure fall below a pressure at which there is a danger that the refrigerant entering the compressor may change state from gas to liquid. This point, the water is interrupted and after the internal gas pressures have returned to a safe range, the water flow is re-initiated. Thus by the enhanced cooling of the refrigerant at the condenser, the overall efficiency of the air conditioning unit is enhanced greatly.

Accordingly, an object of the described invention is to provide a means to increase the efficiency of air cooled air conditioning units.

It is another object of the described invention to provide means and method to water cool an air conditioner condenser with treated water.

Further it is another object of the described invention to provide means and method for protecting the air conditioner unit while enhancing the efficiency of the unit.

DETAILED DESCRIPTION OF PREFERRED EMBODIMENT

Figure 1:
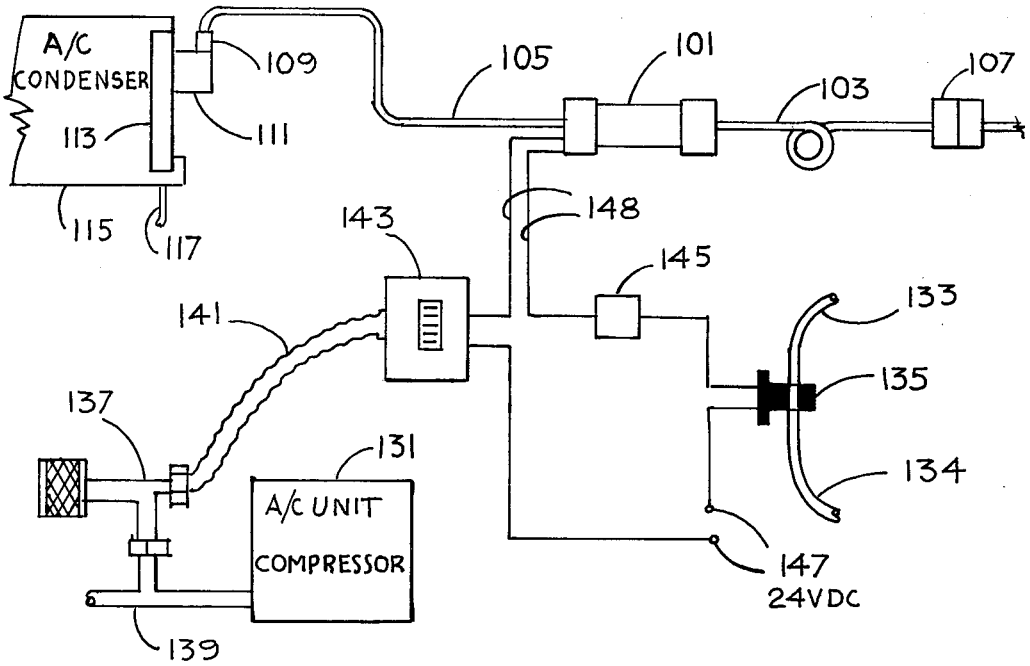
FIG. 1 is a functional block diagram of the subject invention.

Referring now to FIG. 1, a functional block diagram of the invention apparatus is detailed. Proceeding from right to left, the condenser spray unit 101 received water via inlet water pipe 103 for water treatment and dispells the water through outlet water line 105 which conveys the treated water to the spray nozzle 109 which creates the water spray interiorly to the nozzle housing 111. In turn, nozzle housing 111 is situated proximate the air conditioning unit condenser 113, preferably near the top of the finned refrigerant tubing first connected with the air conditioning unit compressor. Situated in the inlet water line is coupling 107, which is a standard type quick coupler made for high pressure air, gas, and water lines. This provides means within which to disconnect the water line as needed or desired, such as removal for winter storage or maintenance.

The water which exits spray nozzle 109 to form the water spray and to contact the air conditioning unit condenser 113 coils runs down the condenser fins and remaining coils held therein to the lower portion of the air conditioning unit housing 115 where it is drained away by means of drain 117.

Thus, it may be seen that through the inventive device treated water is sprayed upon the interior coils of the air conditioning condenser 113 which receives the hot freon or other refrigerant gases from the air conditioning unit compressor and thereby helps to remove and carry away the heat of these gases to facilitate the freon entering its liquid state prior to entrance into the evaporator.

It has been determined that the portion of the invention above described is so effective in increasing the air conditioning units efficiency that a situation develops where it is necessary to switch on and switch off the above device to prevent damage to the air conditioning unit compressor. This is for the reason that there is such a drastic pressure and temperature drop of the high pressure freon gas exiting the compressor resulting in low head pressure and while this is usually a desired situation, the effect is passed through the system resulting in the freon being returned to the compressor in a liquid state after it goes through the evaporator. This is not acceptable as the air conditioning unit compressor must receive the freon in a low pressure gaseous state and then compress it to its high pressure gaseous state. Receipt of the freon in its liquid state by the compressor will result in severe damage to the compressor with early compressor failure. Therefore, it has been necessary to provide controls which sense the air conditioning compressor's high pressure gas output (hereinafter head pressure) and the gaseous input pressure (hereinafter suction pressure) and by sensing same, regulate the flow of water to the condenser coils.

The remainder of the invention shown in FIG. 1 illustrates these sensing mechanisms and their application to controlling the water flow to the condenser coils. Suffice it to say at this point that interiorly to condenser spray unit 101 is an electrical solenoid operating water valve which is inseries with the water entering and exiting the condenser spray unit 101. Attached to the air conditioning unit condenser liquid line output 133 is high temperature sensing switch 135 which physically attaches to the output tubing of the condenser prior to the evaporator to measure the temperature of the liquid refrigerant interiorly thereto. It has been determined that the temperature of the refrigerant exiting the condenser, which receives the compressed refrigerant from the compressor, is directly related to the compressor output temperature and pressure, as the output temperature and pressure are themselves directly related. It is entirely possible to sense the compressor output temperature directly in the invention however, because of the differences in the temperature between the compressor output and the condenser output, the cost of the components is much less and more reliable on the lesser of the temperatures.

Attached to the air conditioning unit compressor 131 input line 139 is the normal standard Schrader type tee valve. In virtually all air conditioning units, a tee has been soldered into the input line 139 for the purpose of injecting the refrigerant into the system and to maintain the refrigerant level. Here, a Schrader tee has been attached to that already existing tee and to one side of the Schrader tee a gas sensing line 141 is connected to the suction pressure switch 143 which continually senses the pressure of the freon or other gas on the input line 139. The high temperature sensing switch 135 electrical outputs are connected in series with the suction pressure switch 143 and is series connected with the input and output of condenser spray unit 101 solenoid operated water valve interiorly thereto. The electrical line exits the condenser spray unit 101 and continues to fuse 145 and then to a source of 24 volt DC shown at electrical terminals 147. The 24 volts DC applied at the shown terminals operates the solenoid valve interiorly to 101 when a circuit is completed through both high temperature sensing switch 135 and suction pressure switch 143. The electrical voltage should be taken from the air conditioner compressor contactor which generally operates on 24 volt DC. This also assures that power will be supplied only when the air conditioner compressor is operating.

It is well known through the temperature-pressure performance charts that in air conditioning units and for specific types of refrigerants, that gas pressures and gas temperatures have a direct mathematical relationship and therefore it is quite possible to measure gas temperature and equate that immediately to gas pressure. In order to sense the air conditioning unit head pressure it is permissible to sense the temperature at the air conditioning unit compressor output-which is also the condenser input. Then this temperature may be directly related to condenser output temperature. This is what is accomplished by the means of high temperature sensing switch 135. The suction pressure switch 143 however, is a direct pressure sensing switch and responds very swiftly to changes in suction pressure. However, the high temperature sensing switch 135 does not respond to temperature changes as swiftly, but the compressor head pressure is not as critical in this application as is the suction pressure.

Also, in accordance with the above law and other laws involved in the physics of air conditioning, different refrigerants will change state from gas to liquid and vice versa at various different interrelated pressures and temperatures and, knowing at what pressure the input gas to the compressor will change state from gas to liquid, the point of same may be sensed and used as a factor in regulating the flow of water to the condenser.

Now it is the characteristics of the high temperature sensing switch 135 that it switches on, i.e., closes its contacts, at a certain temperature and thereafter remains on for all high temperatures. However, due to hysteresis of the switch, turns on at one temperature and turns off at a slightly lower temperature, the temperature differential being about 8 PSI. Similarly, the characteristic of the suction pressure switch 143 is that it is normally on until pressures fall to a specified low pressure and it then turns off. It also exhibits hysteresis and once turned off at a specified low pressure, will not turn on until a second specified pressure, higher than the first, is achieved. This pressure differential is about 5 PSI. Prior to start up of the unit, and after the unit has been at rest for a period of time, all pressures in the air conditioning system have equalized out. This equalized pressure is between the head pressure and the suction pressure. Thus prior to start up of the unit, the high temperature sensing switch 135 will sense a lower than required temperature (pressure) and will be turned off while the suction pressure switch 143 will sense a higher than usual pressure and will be on. Thus no current will pass the electrical circuit and the electrical solenoid valve interiorly to condenser spray unit 101 will not be energized, the valve remain closed, and water will not pass.

Figure 2:
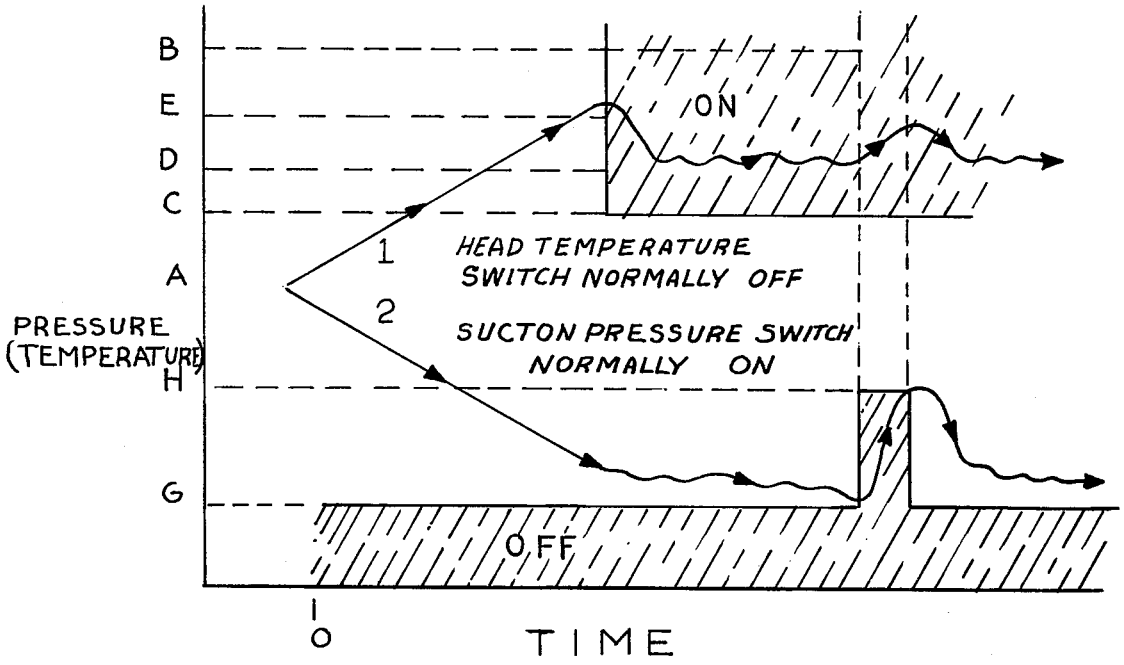
FIG. 2 is a pressure (temperature) graph versus time of the air conditioning unit compressor suction pressure and head pressure.

If reference is made to FIG. 2, a plot of pressure (temperature) versus time after start up is detailed which, it is believed, will simplify understanding of the invention.

Bearing in mind the electrical schematic of FIG. 1, in FIG. 2 at time zero is shown the at-rest head pressure and suction pressure, shown by the intersection of curves 1 and 2 respectively, point "A". At this point in time, the condenser spray unit 101 is not passing water to the spray nozzle attached to the condenser 113. As the air conditioner unit comes on, the head pressure begins to rise until the pressure indicated at "B" is reached at which time the high temperature sensing switch 135 turns on and completes the electrical circuit of FIG. 1, energizing the solenoid valve, opening same, and spraying water upon the condenser coils. A noticable effect in the drop of the head pressure is observed and this is shown on the graph. It is the characteristic of the air conditioning unit that the head pressure will fall off and oscillate about a lower pressure, nominally between points "D" and "E". Shown in FIG. 2 is pressure point "C" which is the low turnoff pressure (temperature) for the high temperature sensing switch 135. Referring now to the suction pressure curve 2 shown in FIG. 2, the suction pressure switch is normally on. Upon start-up, the suction pressure falls greatly at first, but generally down to a level which will asympothically approach the lower cutoff pressure shown by level "G". It must be remembered that many external factors come into play and on a warm day, changes in the temperature of incoming ambient cooling air play a great part in effecting the operation of the air conditioning unit and may be sufficient, upon a cooling breeze, to cause the suction pressure to fall below level "G". When this happens, the suction pressure switch will turn off. This interrupts the electrical circuit shown in FIG. 1, de-energizing the solenoid valve in condenser spray unit 101 and cutting off the flow of water to the air conditioning condenser 113. The suction pressure will immediately rise until the turn-back-on pressure indicated at level "H" has been reached at which the suction pressure switch will turn back on, re-energizing the solenoid and again supplying sprayed water to the condenser 113. Naturally, the pressure level shown by level "G" in FIG. 2 is above the pressure where the gaseous freon condenses to a liquid. The operation above described will continue throughout the time that the air conditioning has been called upon to operate and, when the air conditioner unit is turned off, the above described cooling system is also shut down by means of the high temperature sensing switch 135 turning off as the pressure (temperature) falls below point "C".

For R-22 refrigerant as used in a York model P-36F-10F, 3 ton home air conditioning unit, the following level pressures were observed (all in pounds per square inch), A=165, B=245, C=165, D=180, E=210, G=59, and H=64. As had been mentioned before, the high temperature switch 135 measures the refrigerant tubing temperature after the refrigerant has exited the compressor and passed through the condenser, in the process changing from gas to liquid. The actual temperatures measured which relate directly to points "B" and "C" shown on the graph of FIG. 2 are 90° F. and 82° F. respectively. The suction pressures, points "G" and "H", are also the points at which the suction pressure switch 143 is set.

It is realized that the invention herein described has been adapted to perform with existing air conditioning units. In tests which have been conducted, it has been determined that for an average 90° ambient air temperature day, the unit is actually operating about 20% of the time that the air conditioning unit is operating. This is primarily because the suction switch is turning off the cooling water flow because the invention is so drastically improving the efficiency of the air conditioning unit. It is envisioned that refrigerants will be utilized which have a lower pressure (temperature) gas to liquid change state which will permit a more extended use of the invention before the cooling water spray is interrupted in anticipation of the refrigerant pressure falling to the point where the refrigerant state changes between gas to liquid prior to entering the compressor.

Figure 3:
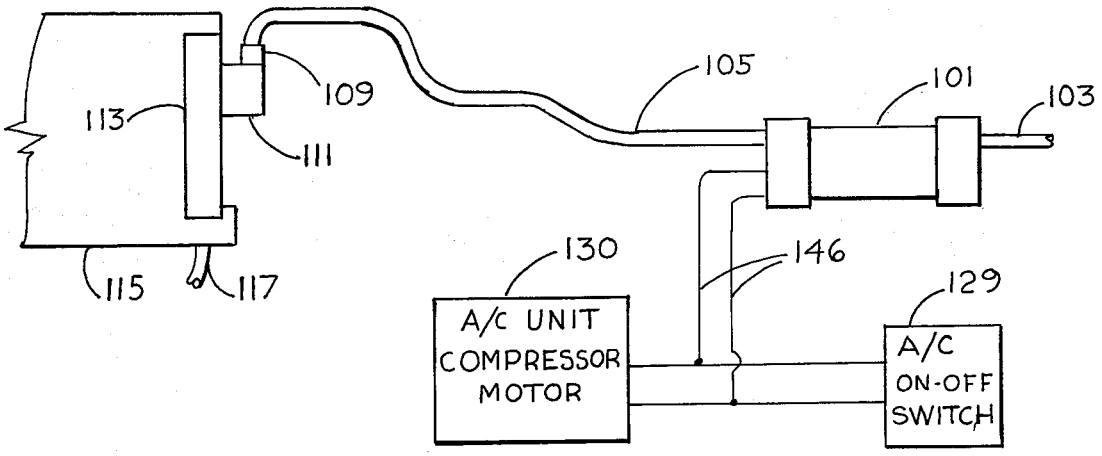
FIG. 3 is a functional block diagram of the invention operating electrical circuit.

In the ideal situation, the invention will supply the water spray at all times that the air conditioner is operating with the only control being the solenoid operated valve in the condenser spray unit connected in parallel with the air conditioning unit compressor motor. This is briefly shown in FIG. 3. Here without modification, the solenoid valve operates at the same electrical potential as does the compressor motor. Also shown in FIG. 3 is the primary air conditioning on-off switch 129 which controls the supply of electrical power to the air conditioning unit compressor motor 130, the electrical solenoid internal to the condenser spray unit 101 having its electrical wires paralleling the compressor motor 130. Here, every time the compressor motor is turned on, the system will be energized and the cooling spray supplied the condenser 113 coils.

Figure 4:
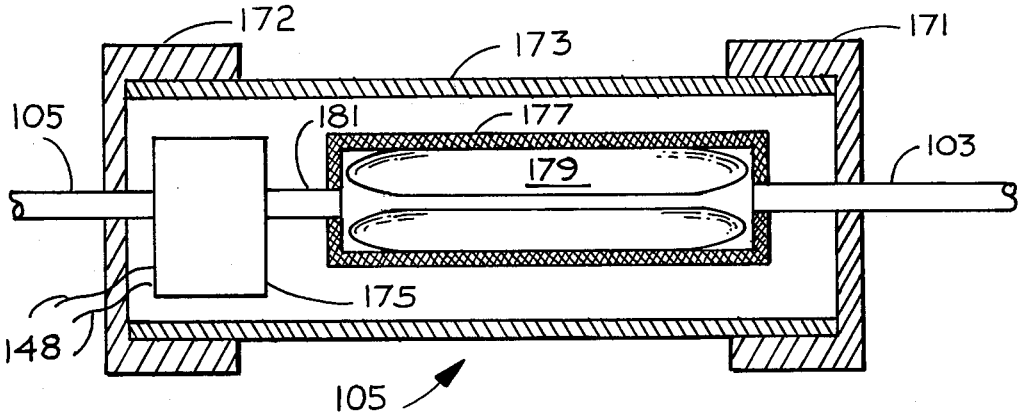
FIG. 4 is a cross sectional view of the condenser spray unit.

Referring now to FIG. 4, a cross sectional view of the condenser spray unit 101 is detailed. Initially, the unit comprises on the outside a closed cylinder, plastic in the preferred embodiment, having opposite ends 171 and 172 which encompass in preferred water-tight configuration, the ends of central cylinder 173. Water inlet pipe 103 penetrates end 171 and outlet water line 105, together with electrical wires 148, penetrate the opposite end 172. Interiorly to cylinder 173 is the electrical solenoid valve 175 which, as earlier described, permits water flow through lines 105 when it is activated, it's normal unenergized state not passing water. Connecting with electrical solenoid valve 175 is interior cylinder 177 which is capped at both ends and interiorly thereto, resides in tight nesting relationship fluid stabilizer rod 179. In the preferred embodiment, interior cylinder 177 is normally constructed of copper and receives water at one end through inlet pipe 103 and discharges water at the other end by discharge pipe 181 to the electrical solenoid valve 175. The interior cylinder 177 is entirely water tight. The fluid stabilizer rod 179 is an elongated tubular rod having, in the peferred embodiment, a cross section which is generally triangular except that its sides are inwardly bowed or hollowed to define lengthwise extending, concave arcuate surfaces, and the rod is generally tapered or nosed at each end. The fluid stabilizer rod 179 comprises generally an alloy of copper, zinc, nickel and tin adapted to be installed in a fluid conduit and to have a fluid flowing thereover. The function of the fluid stabilizing rod is to control and inhibit scale deposition by virtue of its metallurgical composition and physical configuration. It is believed that the scale deposition is controlled by utilizing fluid flow velocity over the rod to determine the size and the quantity of precipitates formed in the fluid. The fluid stabilizing rod is the subject of U.S. Pat. Nos. 3,835,015 issued Sept. 10, 1974, and 3,919,068 issued Nov. 11, 1975, both to W. A. Gray. Reference to those patents is made hereby, which patents describe various configurations of the rod interiorly to a surrounding metal cylinder.

Applicants do not wish to enter into a discussion of the theory of operation of the fluid stabilizer rod except to say that the rod's purpose is to create conditions in the water in order that impurities which may be dissolved therein or which are held in colloidal suspension do not precipitate out to form scale. It has been determined that in order to create these conditions in water, it is necessary that the water pass over the fluid stabilizing rod above a minimum velocity and in a turbulent flow situation.

Once the correct treatment of the water has been accomplished, the precipitate will remain suspended in the water for a period of up to about 36 hours. It is realized of course that if water is permitted to evaporate, it will leave the scale behind. However, in the preferred embodiment the water is drained away and discarded and only new water is introduced to the system.

Figure 5:
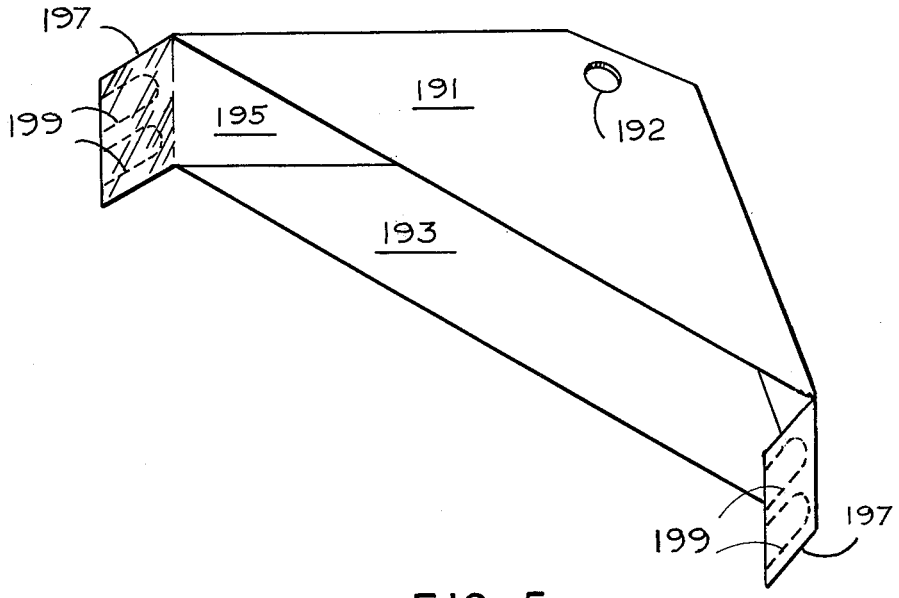
FIG. 5 is a perspective view of the nozzle housing.

Referring now to FIG. 5, a perspective view of the nozzle housing 111 is shown. Generally, the nozzle housing is constructed of sheet metal, nominally aluminum having a generally rectangular shaped top and bottom, parallel surfaces 191 and 193 respectively, with side wall 195 joining the shorter two sides of each triangular shaped surface to form a semi-enclosed plenum with one open side. The side wall 195 is extended on both sides of the triangular top a short distance to comprise end tabs 197, which tabs are generally bent to form a 90° angle with the long side of the triangular shaped surface. It is suggested that these tabs be notched or cut as shown by dotted lines 199 to fit over and hold onto the air conditioning unit condenser coil tubing which runs throughout the finned condenser. It is anticipated that the nozzle housing 111 will join over the condensing coil tubing connected closest to the compressor and that the same turn of condenser coil will engage the top cut out portion of both the end tabs 197 with the second turn of the coil catching the lower cut out portion of end tabs 197. The nozzle housing 111 is then urged next to the fins of the condenser in touching fashion. It is anticipated that the nozzle housing 111 shall reside with its top triangular surface horizontal with the ground, however, it is the intent of the invention that the nozzle housing should follow the general direction taken by the condenser coil tubing. It can be imagined that there will be instances where the tubing may be fashioned in a serpentine manner with the length dimensions in vertical fashion. There, again, the nozzle housing will follow the direction taken by the condenser coil tubing.

The above description is not intended to limit the invention or the invention's placement of the nozzle shield upon the condenser coils, but merely indicates the placement for maximum efficiency. Of course the nozzle shielding could be so placed as to encompass a large plurality of different sections of different turns of the condenser coil tubing.

Since it is the desire of the inventor that the condenser coil tubing proximate the nozzle housing 111 should be completely bathed in the water spray and that minimum opportunity be given the sprayed water to evaporate prior to impingement upon the condenser coils, the construction of the nozzle housing 111 sides are in large part determined by the spray width angle of the spray nozzle 109. In the preferred embodiment, a spray nozzle manufactured by Spraying Systems, Co. carrying the trademark FLOODJET type is utilized which provides a wide deflection type flat spray pattern with low pressure impact and has a spray angle which typically ranges between 128° and 153° for water pressure of 7 PSI to 60 PSI.

It is thus anticipated in the invention that the spray nozzle 109, which is inserted through opening 192 shown in nozzle housing 111, will have a spray angle such that the spray will engage the side wall 195 at or near the point where end tabs 197 are formed. It is the intent of the inventors that a partial vacuum not be formed behind the spray nozzle 109 and interiorly to the nozzle housing 111 in order not to impede the flow of the water spray and that the spray water not be pulled through to the central portion of the air conditioning unit by the fan sucking air through the condenser, but that the sprayed water be deposited upon the cooling coils with minimum splashing or carrying of the water away from the coils. The position of the spray nozzle 109 in the nozzle housing 111 is done such to direct the spray at the condenser coil. Here, the thickness of the nozzle housing 111 is adjusted to similarly conform to the thickness of the water spray although it need not necessarily engage the water spray as does the sides.

Figure 6:
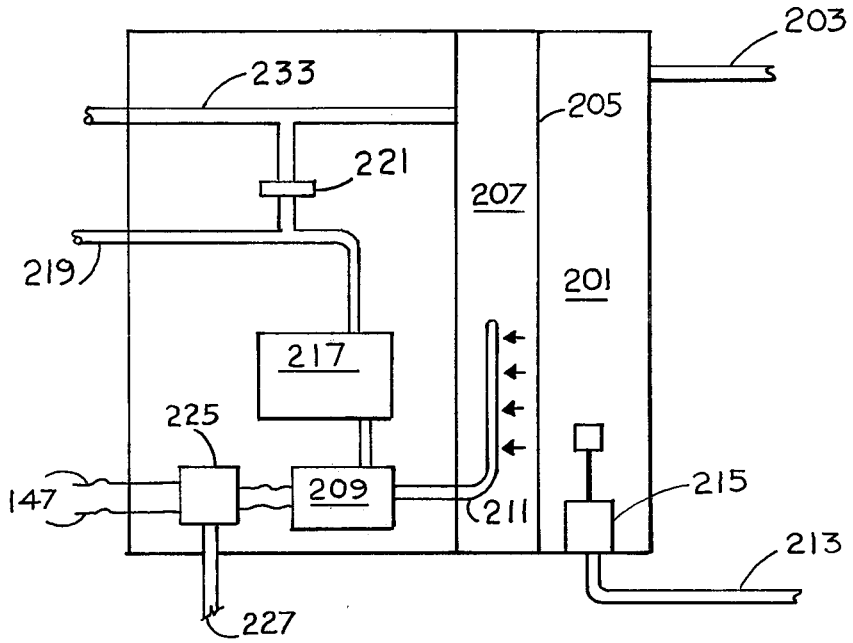
FIG. 6 is a modified top view of water holding and recirculating apparatus.

While in the preferred embodiment, the water which collects in the bottom of the air conditioning unit 115 housing is drained away by means of drain 117 (FIG. 1), means have been devised to recapture and recirculate this water. More specifically, FIG. 6 details apparatus for the capture and recirculation of this water and FIG. 6 shows the top view of a suggested water holding and circulating apparatus. Here, water is returned to holding tank 201 by water return line 203 which connects with the drain 117 shown in FIG. 1. Thereafter particle screen 205 permits water to pass into a second holding tank where the water is picked up by the water pump 209 input suction line 211. Fresh water is permitted to enter into water holding tank 201 through new water inlet line 213, the level of which is controlled by means of float valve assembly 215.

Continuing on, pump 209 output is again sent through a 100 mesh in-line screen assembly 217, the output of which exits the water holding and circulating apparatus shown in FIG. 6 by means of water outlet pipe 219 where it joins with water inlet pipe 103 shown in FIG. 1. It is necessary to continually bleed the water recirculating in the system due to the build-up of dissolved or particles suspended in a colloidal suspension therein because of the continual evaporation of the water, a 10% bleed valve 221 is provided connecting water outlet pipe 219 to a water overflow line 223. The water overflow line also connects with the second holding tank 207 to prevent its overflow and to maintain a constant water level throughout. The pump 209 shown in FIG. 6 is attached in series with the electrical wiring shown in FIG. 1 such that it, like the solenoid contained in condenser spray unit 101, operates during the air conditioner unit running period of time. In order for the fluid stabilization rod to function correctly, a proper water velocity must be maintained over its surface. Therefore, it has been found useful to employ a sufficiently large water pump to achieve the necessary water pressures and velocity, a 220/115 volt motor pump 209 is utilized. Here, the 24 volt DC electrical terminals 147 shown in FIGS. 1 and 7 connects with the coil of relay 225 to pass the 220/110 volt AC to the water pump 209.

Figure 7:
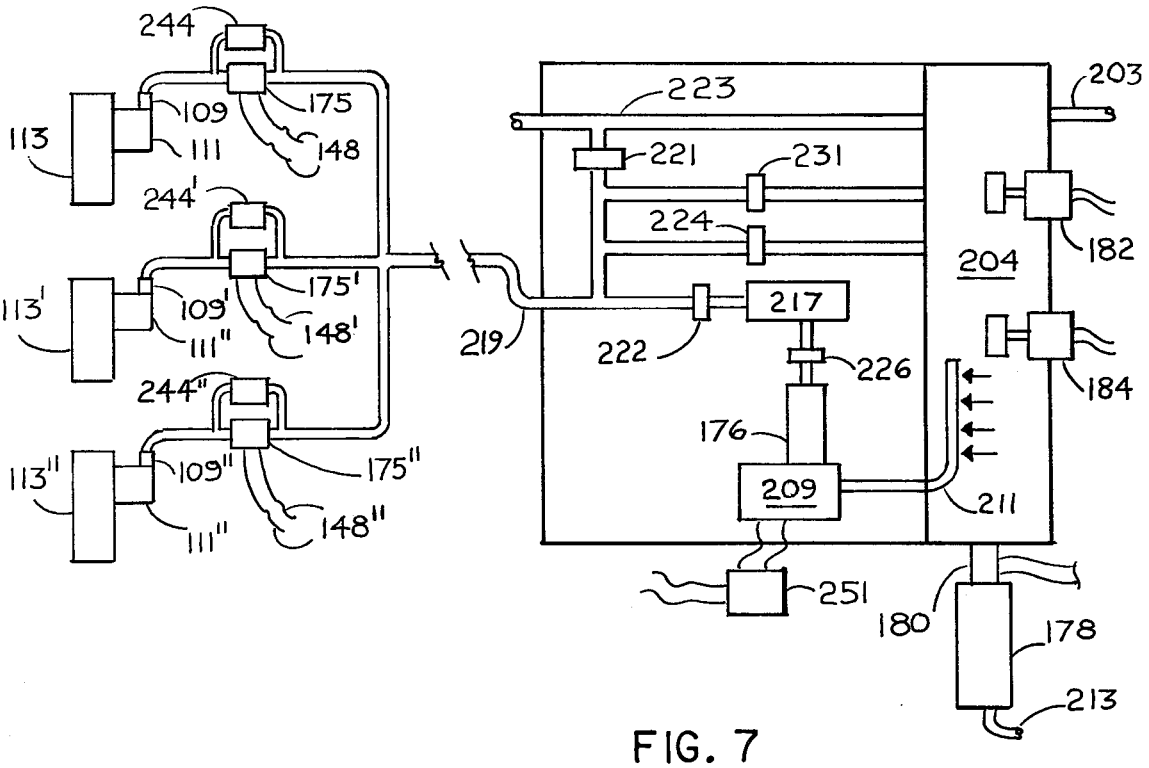
FIG. 7 is a modified top view of the water holding and recirculating apparatus combined with a functional view of the cooling apparatus for a plurality of cooling units.

Additionally, it has been determined that it is possible with the applicant's invention to supply treated water to nozzle housings on a plurality of air conditioning units and to recapture and recirculate the cooling water. For example, FIG. 7 illustrates such a system. FIG. 7 is again a top view of the water holding and recirculating apparatus for the case of multiple air conditioning unit condensers which are also shown in modified block diagram form. To simplify the explanation of FIG. 7, elements which are the same as elements described in FIG. 6 are similarly numbered and do function the same. For example, the water return line 203, the new water inlet line 213, the input suction line 211 to the water pump 209 as well as the 100 mesh in line screen assembly 217, the 10% bleed valve assembly 221, and the overflow line 223 connecting the bleed valve 221. The apparent change in the water holding and recirculating apparatus of FIG. 7 is that the fluid stabilization rod is now located interiorly to cylinder 176 which is connected at one end with water pump 209 and at the other end with a shut-off valve which in turn connects with screen assembly 217. The output side of the screen assembly 217 is attached to one way check valve 222 which allows water flow only to the nozzle housing located at the condensers. One way check valve 222 in turn connects directly with water outlet pipe 219 which in turn directs to the plurality of air conditioning units condensers holding the individual nozzle housings 111. Attached in line with water outlet pipe 219 are a series of protective valves, two of which return water at appropriate times to holding tank 204 and the third to the overflow line 223. The 10% bleed valve 221 has already been described. Pressure bypass valve 231 permits water pumped by pump 209 to by-pass the plurality of condensers when one or more of the condensers have had the water flow thereto cut off and the pressure in the line has increased above a set level. In these cases, the water is merely recirculated by the pump from holding tank 204 around through pressure by-pass valve 231. The other valve which is shown is one way ball check valve 224 which operates such as to inhibit the flow of water from line 219 to the holding tank 204 any time that there is pressurized water in the line. Its function is to automatically drain all lines which are at a higher level than the valve when the pressurized water system has been shut off. Thus the one way ball check valve is closed under pressure and opens up to drain the water from the system at all other times. Shut off valve 226 merely provides a means for shutting off the system in times of winter and for cleaning the in line screen assembly.

Connecting to holding tank 204 is the new water inlet water treating fluid stabilization rod cylinder 178 which connects with the input water line 213. connected in series with cylinder 178 is electrical solenoid 180 which turns on and off at command to permit new water input. Attached to the sides of holding tank 204 are water level sensing switches which perform the following function. Switch 182 is the high level water switch which controls electrical solenoid 180. This assures that an adequate level of water is maintained in holding tank 204 such that there is always sufficient water. Next to switch 182 is low level water cutoff switch 184 which is connected in series with water pump 209 to cutoff the water pump in the event that the water level in the holding tank should fall so low as to impair the water pump. This is purely a safety device for the pump protection.

Connecting with water outlet pipe 219 is water distribution system piping system 241 which connects with the three shown air conditioning units condensers 113, 113', and 113''. Here, connected in the distribution system 241 and prior to the spray nozzle 109 is an electrically actuated solenoid water valve 175. Solenoid water valve 175 is the very same solenoid which was interiorly to the condenser spray unit 101 shown in FIG. 1. This solenoid was even more detailed when the condenser spray unit 101 was shown in cross section in FIG. 4. The solenoid valve has been removed from the condenser spray unit package 101 and has been placed in series connection with the water line directing the water to the spray nozzles 109. Solenoid valve 175 is bypassed by bypass valve 244 which back drains pipe system 241 when water pressure is terminated. Similarly, the wire pair 148 is identical to the wire pair 148 shown in FIG. 1 and the electrical connections with the suction pressure switch 143, fuse 145, and the high temperature sensing switch 135 to the source of 24 volt DC is identical.

This necessarily means that the air conditioning condenser 113 shown in the upper left hand portion of FIG. 7 is the identical air conditioner unit condenser 113 shown in FIG. 1 as is the spray nozzle 109, and nozzle housing 111. Since these controls have been duplicated in the other two shown air conditioning unit condensers in FIG. 7, it is obvious that each and every one of those air conditioning units will have the same sensing devices described above and as shown in FIG. 1.

The solenoid valve 175 still performs the same function, to cut off water to the air conditioning unit condenser when the sensing units indicate that there is danger that the refrigerant, nominally freon, is on the verge of turning to liquid prior to entering the compressor, or that the compressor head pressure has fallen too much.

When the system as described in FIG. 7 is connected and one or more of the electrical solenoids 175 have closed the water line and it is still necessary to service other units, in order to maintain the required water flow velocity over the fluid stabilization rod contained within cylinder 176 attached to pump 209, it is necessary to reroute the water around the closed off condensers and this is done by means of pressure by-pass valve 231. As pressure in the water system builds up, the by-pass valve opens up and passes the water that would normally flow through the now closed off water spray nozzle. It has been found convenient in utilizing the system that the water pump 209 should run continuously without having to sense whether any of the air conditioning units are on as there will be many cases where these units will be spaced at great distances and may involve such a plurality of units, perhaps in excess of 100. Applications to individual air conditioning units situated in motel rooms first comes to mind. In this case, it is suggested that the water pump 209 motor be connected to a temperature sensing switch 251 where, for example, whenever the ambient temperature rises above some valve, perhaps 75° F., the pump will be turned on.

Figure 8:
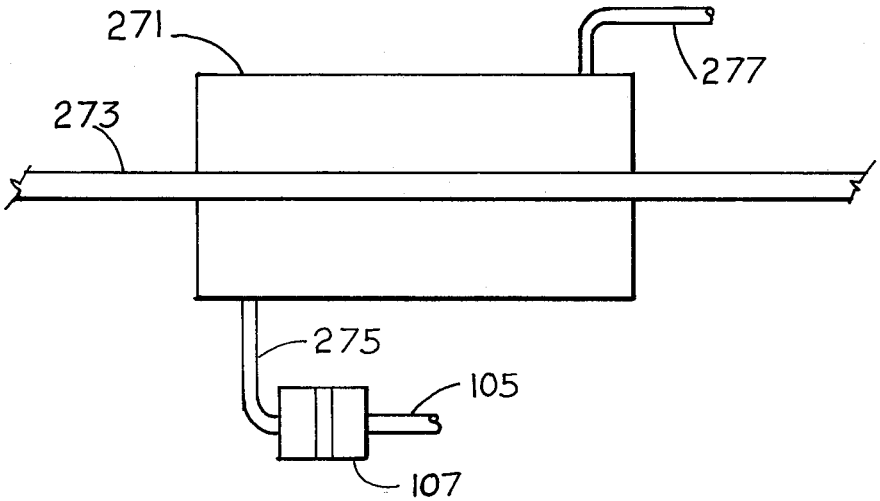
FIG. 8 is a cross sectional view of an alternate embodiment for water flood cooling of the condenser coil tube.

An alternate embodiment of the subject invention is shown in FIG. 8 where a change has been made to the preferred embodiment of FIG. 1 by substituting spray nozzle 109 and nozzle housing 111 with a water bathing cooling unit 271. Here, the air conditioning unit condenser 113 refrigerant tubing coil 273 is intercepted between the air conditioning unit compressor and the finned portion of the condenser 113. This nominally is a short piece of tubing which runs from the compressor to the top of the condenser. Surrounding the condenser coil tube 273 is enclosed container unit 271 which has water entrance line 275 and water exit line 277, the entrance line situated at a point below the exit line so that the cooling unit 271 interior will be completely flooded before the water may exit. Shown in FIG. 8 is the coupling 107 which corresponds to the similar coupling 107 in FIG. 1. Water bathing cooling unit 271 has its ends punctured to receive condenser coil tube 273 and all joints are sealed by soldering or by the use of waterproof seals. All other aspects of the invention remain the same and all of the temperature sensing devices shown in the preferred embodiment of FIG. 1 are incorporated in the alternate embodiment of FIG. 8.

As an aside, it has also been found useful in the preferred embodiment shown in FIG. 1 that the outlet water line 105 should be constructed of flexible high pressure hose to absorb the shock of water hammer when the solenoid operated valve interiorly to condenser spray unit 101 turns on and off.

In the preferred embodiment it has been found useful to use commercially available parts and some of the parts which need more description than their generic names are as follows. The pressure suction switch 143 is manufactured by Johnson Controls, Penn Division, Model No. P-70AB-2; the high temperature sensing switch 135 is manufactured by Texas Instruments, Model No. 20640F44-124-28-F-100-1.5U7V; the electrical solenoid 175 is manufactured by ASCO, Model No. US82617; the water pump 209 is manufactured by Little Giant, Model No. 35 OM; the 100 mesh inline screen assembly is manufactured by Spraying Systems Co., Model No. TW-B100; bleed valve 221 is manufactured by Spraying Systems Co., Model No. 4908-¼T; pressure by-pass valve 231 is manufactured by Spraying Systems Co., Model No. 6815G-¾-300; the float valve assembly 215 is manufactured by Rodot, Model No. RN-150; and water level sensing switches 182 and 184 are manufactured by Compac Engineering, Inc., Model No. 650-P. By-pass valves 224 and 244 are manufactured by Spraying Systems Co., Model No. ¼ AB Ball Check Valve.

While a preferred embodiment and alternate embodiment of the invention have been shown and described, it will be appreciated that there is no intent to limit the invention by such disclosure, but rather it is intended to cover all modifications and alternate constructions falling within the spirit and the scope of the invention as defined in the appended claims.

We claim:

1. Apparatus for increasing air conditioner efficiency by cooling the air conditioner compressor pump high temperature high pressure refrigerant gas outlet pipeline by water spray at the air conditioner condenser comprising means to treat water, said means including a fluid stabilizer rod in communication with the water to retain in the water particulate matter dissolved and suspended in the water; and means to bathe a portion of the compressor gas output pipeline with a spray of water so treated, said means including a nozzle and a shield to selectively direct the water to a portion of the pipeline, said nozzle located interiorly to said shield, and said shield attached to the air conditioner condenser adjacent said compressor gas output pipeline whereby the refrigerant gas is cooled by the spray of water and the particulate matter in the water does not precipitate out to form scale upon the compressor gas output pipeline or cooling fins of the air conditioner condenser.

2. Apparatus for increasing air conditioner efficiency as defined in claim 1 wherein said shield comprises triangularly shaped box open on one side, said nozzle positioned interiorly said shield opposite said open side, said shield defining the water spray configuration, and said shield open side located adjacent said compressor gas output pipe line at the air conditioner condenser thereby permitting said water spray to intersect said gas output pipe line and cool same by the water evaporating and running off, carrying the heat with it.

3. Apparatus for increasing air conditioner efficiency as defined in claim 2 wherein said means to bathe the compressor gas output pipe line with treated water spray includes means to controllably regulate the water spray.

4. Apparatus for increasing air conditioner efficiency as defined in claim 3 wherein said means to controllably regulate the water spray includes means to interrupt the water spray whereby the cooling of the compressor gas output pipe line may be made intermittant.

5. Apparatus for increasing air conditioner efficiency as defined in claim 4 wherein said means to controllably regulate the water spray includes suction pressure gauge means to detect the air conditioner compressor input line refrigerant gas pressure.

6. Apparatus for increasing air conditioner efficiency as defined in claim 5 wherein said means to controllably regulate the water spray includes head temperature determination means to detect the air conditioner compressor output line refrigerant gas temperature.

7. Apparatus for increasing air conditioner efficiency as defined in claim 6 wherein said head temperature determination means to detect the compressor output line refrigerant gas temperature comprises means to detect the air conditioner condenser output line refrigerant gas temperature.

8. Apparatus for increasing air conditioner efficiency as defined in claim 7 wherein said means to controllably regulate the spray of water includes a source of electrical power; and electrical wires interconnecting said suction pressure gauge means, said means to detect the condenser output line refrigerant gas temperature, said means to interrupt the water spray, and said power source whereby said water is permitted to spray when said compressor output line gas refrigerant temperature reaches a certain value, and said water spray is terminated when said suction pressure drops below a certain value.

9. The apparatus for increasing air conditioner efficiency as defined in claim 8 further including means to collect the treated water at the air conditioner condenser after it is sprayed, and means to recirculate the water so collected to the water treating means.

10. Apparatus for increasing air conditioner efficiency by cooling the air conditioner compressor pump high temperature high pressure refrigerant gas output pipeline with water comprising means to treat the water to retain in the water particulate matter dissolved and suspended therein; means to immerse the compressor output gas pipeline in a flow of treated water, said means including a closed container having an inlet and an outlet, said closed container encompassing the output pipeline; and means to controllably regulate the flow of water into the closed container, said means including means to detect the compressor input line refrigerant gas suction pressure and means to detect the compressor output line refrigerant gas head temperature, whereby the treated water may controllably flow into said closed container surrounding said output pipeline, remove heat therefrom, and flow out of said closed container in accordance with the head temperature and suction pressure so detected.

11. Apparatus for increasing air conditioner efficiency as defined in claim 10 wherein said means to treat the water includes fluid stabilizer rod means, and means to pass the water by said fluid stabilizer rod means.

12. A method for increasing air conditioner efficiency by cooling the air conditioner compressor pump high temperature high pressure refrigerant gas output pipeline with water at the air conditioner condenser comprising the steps of:

(a) treating water to retain in the water particulate matter dissolved and suspended therein, (b) sensing the air conditioner compressor pump input refrigerant gas pressure, and (c) sensing the compressor pump refrigerant gas output temperature, and (d) controllably bathing the compressor pump refrigerant gas output pipeline with the treated water in accordance with compressor input gas pressure and output temperature so sensed whereby the water carries off the heat from the high temperature high pressure refrigerant gas output pipeline and the pipeline is not scaled by the particulate matter in the treated water.

13. The method for increasing air conditioner efficiency as defined in claim 12 wherein the step of controllably bathing the compressor gas output pipe line additionally comprises the step of forming a water spray to bathe the output pipe line.

14. The method for increasing air conditioner efficiency as defined in claim 13 wherein the step of forming a water spray to bathe the compressor output pipe line includes the step confining the water spray so formed by a shield.

15. The method for increasing air conditioner efficiency as defined in claim 14 wherein the step of treating water to retain particulate matter includes the step of passing water by a fluid stabilizer rod.

16. The method for increasing air conditioner efficiency as defined in claim 12 wherein the step of controllably bathing the compressor pump refrigerant gas output pipeline with treated water includes the step of interrupting the bathing with water when the compressor pump input refrigerant gas pressure falls below a certain value, and interrupting the bathing with water when the compressor pump refrigerant gas output temperature rises above a certain value.

17. The method for increasing air conditioner efficiency as defined in claim 15 further including the step of recirculating the treated water, said step including the step of collecting the water, returning the water to a water pump, and pumping the water to the means treating the water.

* * * * *